United States Patent [19]

Dupuis

[11] Patent Number: 4,494,690

[45] Date of Patent: Jan. 22, 1985

[54] CONTAINER

[76] Inventor: Emmanuel F. Dupuis, 21 Prince Philip Dr., St. Catharines, Ontario L2N 3H9, Canada

[21] Appl. No.: 491,110

[22] Filed: May 3, 1983

[51] Int. Cl.[3] ..... A47G 29/12

[52] U.S. Cl. ..... 232/22; 232/1 C; 232/43.1

[58] Field of Search ..... 232/1 C, 1 E, 17, 19, 232/22, 43.1, 43.5

[56] References Cited

U.S. PATENT DOCUMENTS

| | | | |
|---|---|---|---|
| 391,710 | 10/1888 | Heller | 232/22 |
| 723,939 | 3/1903 | Stinson | 232/22 |
| 830,502 | 9/1906 | Hasseman | 232/22 |
| 1,128,678 | 2/1915 | Giclas | 232/22 |
| 2,470,138 | 5/1949 | Browning | 232/22 |
| 3,640,451 | 2/1972 | Lewis | 232/43.1 |
| 4,098,454 | 7/1978 | Easter | 232/19 |

*Primary Examiner*—Robert P. Swiatek

*Attorney, Agent, or Firm*—Rogers, Bereskin and Parr

[57] ABSTRACT

A container, for newspapers or other articles, is arranged for mounting on an edge of a door, by means of, for example, an L-shaped clip. The container has a first opening through which an article can be inserted. The first opening is provided with a device for at least hindering removal of the articles. The device could be inwardly directed flanges around the first opening. A second opening is provided for removal of articles. It is closed when the door is closed and is opened when the door is opened to permit removal of articles from the container. The second opening can be provided on one edge of the container, so that it is closed by a doorjamb associated with the door.

13 Claims, 8 Drawing Figures

FIG. 3
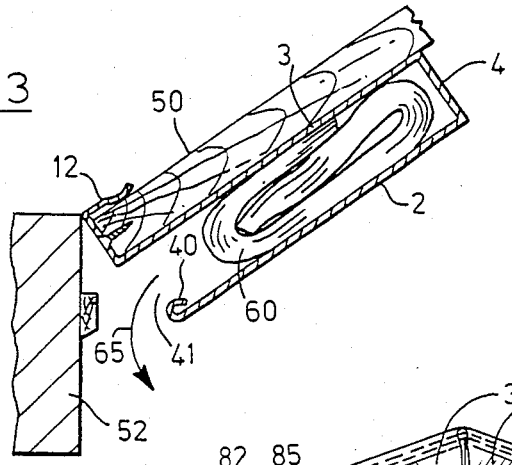
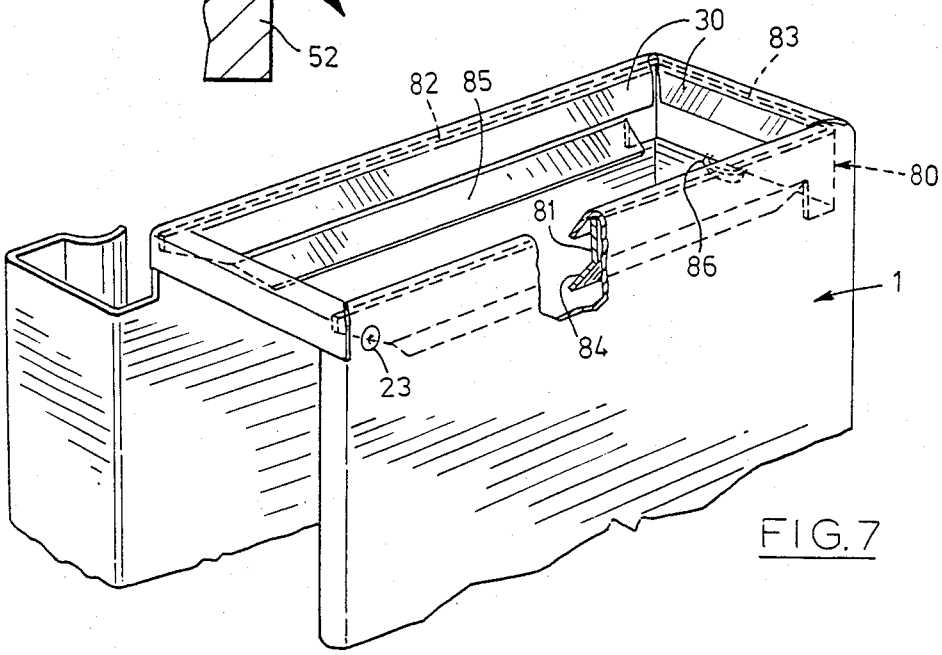
FIG. 7
FIG. 8
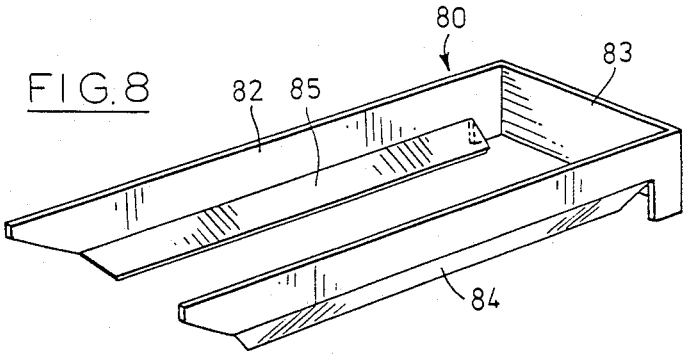

FIG. 5
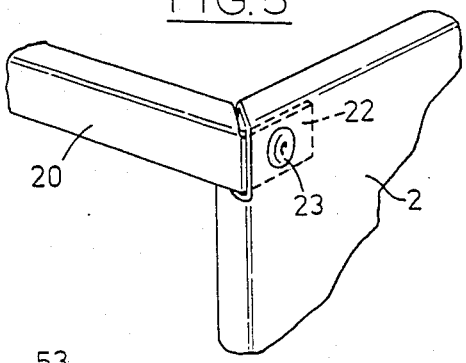
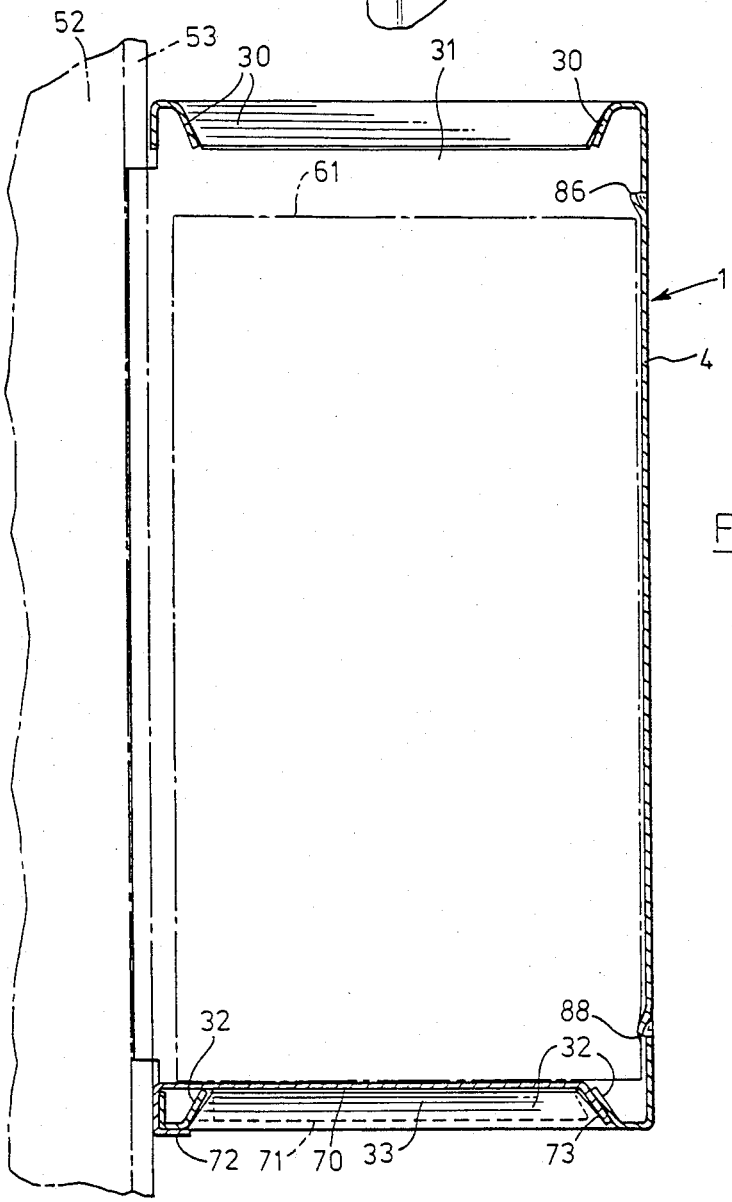
FIG. 6

CONTAINER

This invention relates to a container, and this invention more particularly, but not exclusively, relates to a container suitable for newspapers.

Delivery of newspapers and other articles to people's residences or to offices can be a problem. In particular, delivery to multiple occupancy dwellings, such as apartment blocks can be difficult, as letter or mail flaps are often not provided. Even when a letter box or flap is provided on each door, it is ofen too small to accept newspapers and large articles. Consequently, someone delivering a newspaper or other large articles can only leave it outside the door, if the apartment or dwelling is unoccupied. This is unsatisfactory, since the newspaper or other articles can be damaged, tampered with or removed.

Accordingly, it is an object of the present invention to enable newspapers to be delivered safely to apartments and other dwellings.

According to the present invention there is provided a container for articles, the container having a first opening through which articles can be inserted into the container and which includes first means for at least hindering removal of articles from the container through the first opening, and a second opening for removal of articles from the container, the container, in use, being adapted to be mounted on an edge of a door having an associated doorjamb, whereby when the door is in a closed position, the second opening is closed by the doorjamb, but when the door is opened the second opening is also opened to permit removal of articles from the container through the second opening.

The container is preferably adapted to be mounted on a door by means of a clip, which can be an L-shaped section integral with a main body of the container. Such a construction enables the container to be readily mounted on and removed from a door without the use of any special tools. The container is simply slipped onto the chosen edge. The clip can be coated with a soft or resilient material, to ensure that the door is not damaged in any way.

The container can be provided with two first openings at either end. Such a construction provides a one-piece container which can be mounted on either edge of both left and right hand doors. Also, as it is a one-piece construction, it could be formed from a single sheet of material.

In a preferred form of the invention, the container is of rectangular section with rectangular first openings at either end. This provides a slim unobtrusive container that is easy to use. A newspaper delivery boy merely has to fold a newspaper a few times before insertion through one end opening into the container. The rectangular shape means that the openings at either end can be of slim rectangular section. Each opening is preferably provided with inwardly directed flanges around its entire periphery. This shape provides a large enough area for insertion of the paper, but prevents a newspaper being easily removed. It is difficult for a potential thief to insert his hand into the container and grasp the paper. Even if he can grasp the paper, he then has the problem of compressing the paper so that it will clear the flanges surrounding the periphery of the opening.

The rectangular shape also means that the container can be readily mounted between the front door and storm or screen door of a dwelling. It could be, for example, 2½" deep which is adequate for most door spacings. A container so mounted on a front door behind a storm door will then ensure that a newspaper is protected from the weather.

Further security can be provided with an additional flanged device, which makes it very difficult to remove a newspaper illicitly.

The container provides a simple means of ensuring safe delivery of articles. When mounted on a free edge of an inwardly opening door, a paper can be removed from within the dwelling.

The container can either be mounted on an edge of the door attached to the hinges, or the free edge of the door.

For a better understanding of the present invention, and to show more clearly how it may be carried into effect, reference will now be made, by way of example, to the accompanying drawings, in which:

FIG. 3 shows the same section as FIG. 2, with the door opened;

FIG. 5 shows a detail V of FIG. 4;

FIG. 6 shows a section VI—VI of FIG. 4;

FIG. 7 shows a view similar to FIG. 4 including a guard member; and

FIG. 8 shows a perspective view of the guard member shown in FIG. 7.

The container shown is generally designated by the reference number 1 and is formed from a single piece of sheet metal.

Figure 4:
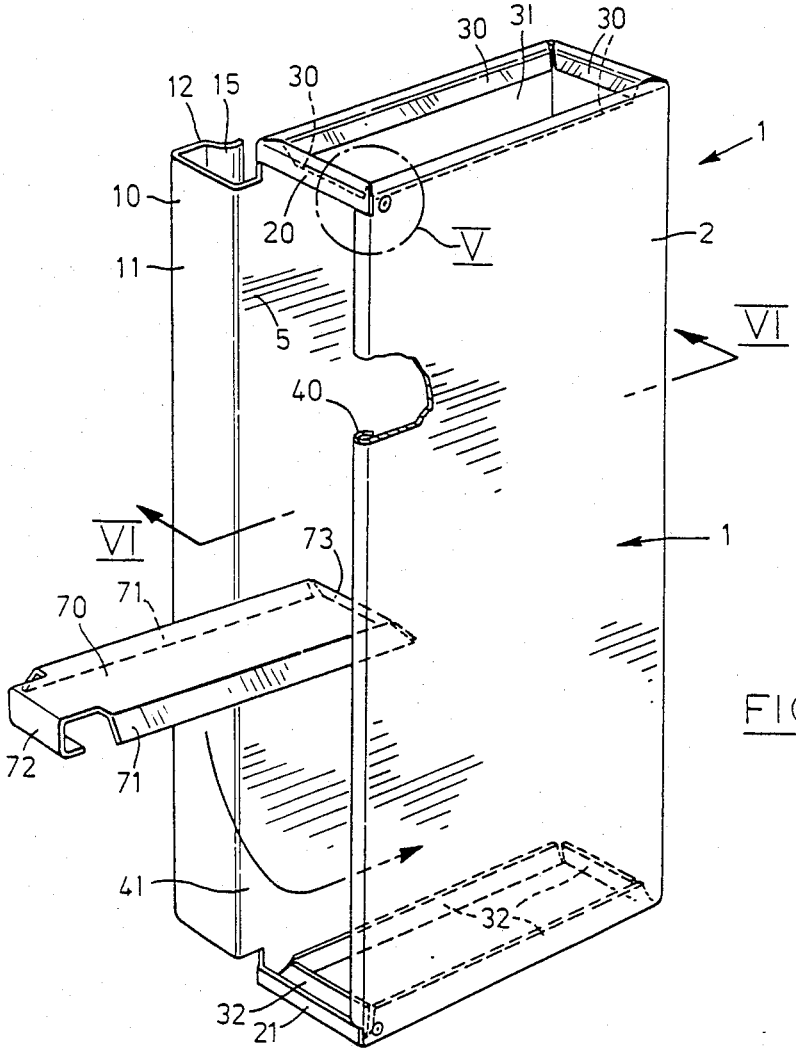
FIG. 4 shows a perspective view of the container, together with a floor for the container.

As shown in FIG. 4, the container 1 has a generally rectangular front panel 2, and a corresponding generally rectangular rear panel 3. A side panel 4 is continuous with the front and rear panels 2 and 3. Extending from an edge of the rear panel 3 is an extension strip 5. Continuous with the extension strip 5 is an L-shaped clip 10.

The L-shaped clip 10 comprises a first limb 11 continuous with the extension strip 5, and a second limb 12 which extends generally parallel to the front and rear panels 2 and 3. The second limb 12 comprises two portions 13 and 14, (FIG. 2) which include an obtuse angle, to form a rounded ridge 15. In an unstressed state, the angle between the first limb 11 and the portion 13 is less than 90°.

Extending from top and bottom corner portions of the rear panel 3, adjacent to the extension strip 5, are two cross pieces 20 and 21. As shown for the crosspiece 20 in the detail of FIG. 5, each of the crosspieces 20 and 21 is provided with a tab 22, which is secured by a rivet 23 to the front panel 2.

At the top of the container 1, as shown in FIG. 4, each of the front and rear panels 2,3, the side panel 4 and the crosspiece 20 is provided with a respective flange 30, which is continuous therewith. Each of these flanges 30 is directed inwardly towards the center of the container 1, as is shown clearly in the crosssection of FIG. 6.

The bottom of the container 1, as viewed in FIG. 4, is similarly formed. Again, each of the front panel 2, the rear panel 3, the side panel 4 and the crosspiece 21 is provided with a respective flange 32, which is continuous therewith. These flanges 32 are generally symmetrical with the flanges 30 and extend inwards towards the center of the container 1.

The flanges 30 define an opening 31 at the top of the container 1 (as shown in FIG. 4), while the other flanges 32 define a similar opening 33 at the bottom of the container 1.

Figure 1:
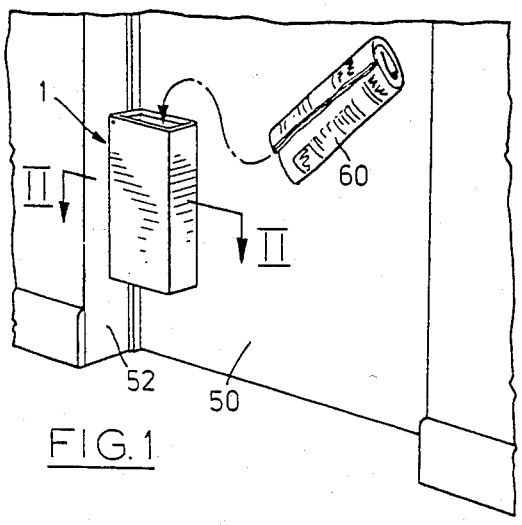
FIG. 1 shows a perspective view of a container according to the present invention mounted on a door.

The container 1 is shown provided with symmetric openings 31 and 33 at its top and bottom, in order to enable it to be mounted on either edge of either door. Thus, FIG. 1 shows a door which is hinged along its left-hand edge, and which opens inwards as viewed in FIG. 1. The container 1 is then mounted on the hinged left-hand edge of the door, with the opening 31 uppermost. Similarly, if the door shown had been hinged on its right-hand edge, then the container 1 could be inverted and again clipped on the other right-hand edge of the door. The opening 33 would then be uppermost, with the opening 31 at the bottom. The container 1 would still function in the same way.

A free edge 40 of the panel is turned back, so that no raw metal edge is directed outwards. This edge 40 could be shaped to form a triangular section along the free edge region to the front panel 2. Between this free edge 40, the extension strip 5 and the crosspieces 20 and 21, another opening 41 is defined.

If it is desired to provide a container 1 which is positively closed at its lower end, a floor member 70 (FIG. 4) can be provided. This floor member 70 is provided on two sides with downwardly extending flanges 71 corresponding to the flanges 32. At one end, the floor member 70 is provided with a location tongue 73, whilst at the other end a hook shaped portion 72 is provided. As shown in FIG. 6, the location tongue 73 is engaged below the flange 32 of the side panel 4, and the hook-shaped portion 72 is then engaged with the crosspiece 21. The bottom of the container 1 is positively closed, and the floor member 70 cannot be pushed upwards from below. This could prove particularly advantageous, if the container is intended for use with ordinary mail, and not just for newspapers. If the container 1 is inverted as discussed above, then the floor 70 can be similarly engaged at the other end to close the opening 31.

Figure 2:
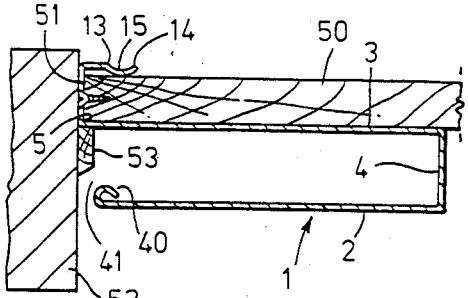
FIG. 2 shows a section along the line II—II of FIG. 1.

In use, the container 1 is mounted on an edge of a door. In FIGS. 1, 2 and 3, the container 1 is shown mounted on an edge 51 of a door 50, which edge 51 is secured to the hinges (not shown) of the door 50. The edge 51 is connected by such hinges to an associated doorjamb 52 having a door stop 53. The container 1 is preferably secured simply by the resilient clamping actionof the L-shaped section 10. In this case, the container 1 can be located on the door so that the L-shaped section 10 is immediately above and abuts a hinge, so that vibration and the like cannot cause the container 1 to slide down the door.

Alternatively, permanent fixing means such as screws can be used to secure the container 1 to the door 50 This is less preferred as it marks the door.

With the door 50 closed, as shown in FIGS. 1 and 2, the opening 41 is effectively closed by the doorjamb 52. A newspaper, shown at 60 in FIG. 1, can then be inserted through the upper opening 31. Then, as shown in FIG. 6, the newspaper will naturally tend to expand and adopt the shape marked 61. As a result, even if the platform 70 (shown in FIG. 6) is absent, the flanges 32 around the opening 33 serve to prevent the newspaper 60 falling out of the container 1. Simultaneously, the flanges 30 around the opening 31 at the top of the container 1 prevent unauthorized removal of the newspaper 60 through the opening 31.

To remove the newspaper 60, the door 50 is opened, as shown in FIG. 3. The opening 41 is then opened and unobstructed by the doorjamb 52. The newspaper 60 can then be removed through the opening 41, as indicated by the arrow 65 in FIG. 3.

It should also be noted that the container 1 does not have to be mounted on the hinged edge of the door. It could be mounted on the free edge of the door adjacent the handle. This arrangement has the advantage that the door then only has to be partially opened to move the container 1 sufficiently far from the doorjamb, to leave the opening 41 unobstructed. This could prove advantageous in dwellings with inwardly opening doors. The occupier can open the door from within the apartment or house sufficient to present the opening 41 at the gap between the door and the doorjamb. A newspaper within the container 1 can then be removed through the opening 41, without the occupier having to leave his dwelling. Further, if the door is provided with a security chain of sufficient length, the door can be opened and the newspaper removed in this manner, without the security chain having to be removed. If the container 1 is mounted in this manner on a free edge of the door, again it is advantageous if the container 1 is clipped onto this free edge so that it is against a bracket for the handle or the lock, to prevent any downward movement of the container 1. In order to ensure that the handle or lock will not be obstructed, the rear panel 3 of the container 1 can be provided with a downward extension piece, so that the container 1 will never obstruct the lock or handle.

In order to make the container more secure, an additional flanged guard member 80, shown in FIGS. 7 and 8, can be provided. The guard member 80 is generally U-shaped and comprises a front portion 81, a rear portion 82, and a connecting portion 83. Each of the front and rear portions 81 and 82 is tapered at its free end. Also, each of the front and rear portions 81 and 82 includes a respective inwardly directed flange 84, 85. As shown in FIG. 6, the side wall 4 is stamped to provide a projecting ledge 86. To insert the guard member 80, the free ends of the portions 81, 82 are engaged behind the crosspiece 20. Then, the rear portion 83 is swung upwards and past the ledge 86, so that its lower edge rests on the ledge 86 to secure the guard member 80 in position. Each of the portions 81, 82 and 83, including the flanges 84,85 is 2" deep. The guard member thus provides additional flanges spaced below the flanges 31, so that it is very difficult to remove a newspaper through the top opening of the container. Like the floor member 70, the guard member 80 is arranged to be positioned at an appropriate end of the container. For this purpose, a second ledge 88 is provided adjacent the other opening 33. When a guard member 80 is provided the container should be so dimensioned that a newspaper or other article does not protrude above the guard member 80.

Although the crosspieces 20, 21 are shown connected to the front panel by means of rivets 23 in FIG. 5, it is to be realized that the crosspieces 20, 21 could be connected to the front panel 2 in a variety of different ways. For example, the free edge 40 of the front panel 2 could include a strip extending towards the rear panel 3. Then, the tabs 22 could be eliminated and the crosspieces 20, 21 could be riveted or otherwise secured to this strip.

It has also been found advantageous to incline the strip 5 relative to the rear panel 3 by a small angle of, for example, 40, so that an obtuse angle is formed between the strip 5 and the rear panel 3 on the side remote from the front panel 2. If the container 1 then comes slightly loose or disengaged from the door 50 when it is open, as the door 50 is closed, this small angle ensures that the L-shaped clip 10 clears the door stop 53. As the door door 50 is closed, the container 1 is then pressed onto the door 50.

While the above description has primarily been directed to a container for newspapers, it is to be appreciated that the container could be used for a wide variety of articles. In particularly, as previously mentioned, the container could be used for mail. For this purpose, the container could be formed with different dimensions. Indeed, separate containers for both mail and newspapers having different dimensions could be provided. It is also possible that one container could be provided with two or more separate compartments for different sized articles, each compartment having an associated upper opening and an associated side opening for closure by a doorjamb.

For use for newspapers, the following dimensions have been used. The container had a height of 18½", a width of 8" and a depth of 2½". The height could be increased to as much as 20" to accomodate larger newspapers. The extension strip was ¼" wide. Each limb of the L-shaped portion 10 was 1⅞" wide, with the portions 13 and 14 being 1⅛ and ¾" wide respectively. Each of the flanges 31 and 33 was formed by a horizontally extending strip of ¼" width and an inwardly directed portion of ½" width, the inwardly directed portion being at an angle of 60° to the horizontal portion.

While the described embodiment of the container is formed from sheet metal, other materials could be used. In particular, the container could be formed from a plastics material. Alternatively, the container could be formed from sheet metal with the L-shaped section 10 and associated parts of the rear panel 3 coated with a plastics material, so that an edge of a door to which the container is clipped is not scratched or otherwise damaged.

I claim:

1. A container comprising:

a main body which has the shape of a generally rectangular parallelepiped, and which comprises a front panel, a rear panel parallel to and spaced from the front panel, a side panel perpendicular to and extending between the front and rear panels, and first and second crosspieces extending between corner regions of the front and rear panels remote from the side panel, whereby one first opening is defined at one end by the first crosspiece and the front, rear and side panels, a second opening is defined at another end opposite said one end by the second crosspiece and the front, rear and side panels, and a third, side opening is defined opposite the side panel by the first and second crosspieces and the front and rear panels, with each of the first and second openings being provided with at least one inwardly directed flange to hinder removal of articles from the container through the first and second openings;

and a clip means comprising an L-shaped section, which has one limb continuous with and perpendicular to the rear panel adjacent to the second opening and another limb parallel to the rear panel to enable the container to be clipped to a door;

whereby, in use, when the container is clipped by the clip means to an edge of a door having an associated doorjamb with one of the first and second openings uppermost, articles can be inserted into the container through said uppermost one of the first and second openings, and when the door is closed the third opening is closed by the doorjamb to prevent removal of articles therethrough, but, when the door is opened, is opened to permit removal of articles from the container through the third opening.

2. A container as claimed in claim 1, wherein each of the first crosspiece and the front, rear and the side panels is provided with an inwardly directed flange for the first opening, and each of the second crosspiece and the front, rear and side panels is provided with an inwardly directed flange for the second opening.

3. A container as claimed in claim 2, which includes a floor member adapted to be clipped to the container to close one of the first and second openings, the floor member comprising a generally rectangular floor portion, three flanges extending at an angle to the floor portion from three edges thereof and corresponding to the inwardly directed flanges of the front, rear and side panels, and a clip portion extending from a fourth edge of the floor portion and adapted to clip the floor member to one of the first and second crosspieces.

4. A container as claimed in claim 1, which is provided with a flanged device which has a set of flanges, and which can be positioned adjacent the uppermost of the first and second openings with said set of flanges directed inwards and spaced from the respective flange(s) of that opening.

5. A container as claimed in claim 4, wherein the flanged device is generally U-shaped and comprises first and second limbs each of which includes a respective flange and a connecting portion continuous with the first and second limbs, whereby, in use, one of the first and second limbs abuts the front panel of the container and the other of the first and second limbs abuts the rear panel, and the connecting portion abuts the side panel.

6. A container for articles, the container comprising: a main body for receiving articles; resilient clip means extending from the main body for securing the container to an edge of a door; two first openings each of which includes a respective first means associated only with the peripheries of the openings for at least hindering removal of articles from the container, the first openings being provided at opposite ends of the main body; a second opening in the main body for removal of articles therefrom; the container, in use, being adapted to be mounted by said clip means on an edge of a door having an associated doorjamb, with one first opening facing downwards, and with the first means associated with said other first opening preventing articles within the container from falling out of the container, whereby articles can be inserted into the container through said one first opening, and when the door is closed the second opening is closed to prevent removal of articles therethrough, but when the door is opened the second opening is also opened to permit removal of articles from the container through the second opening.

7. A container as claimed in claim 6, wherein the first means for each of the first openings comprise inwardly directed flanges around the respective opening.

8. A container as claimed in claim 7, which includes a floor member which in use, is engaged with the container to close the first opening facing downwards, to prevent any articles falling out of the container through the downwardly facing first opening.

9. A container as claimed in claim 6, in which said clip means comprises an L-shaped section integral with the main body.

10. A container as claimed in claim 9, wherein the L-shaped clip means has a first free limb which includes a ridge having an obtuse angle adpated to abut a face of a door.

11. A container as claimed in claim 9, wherein the L-shaped clip means includes one free limb and another limb continuous with the one free limb and with the main body of the container, and wherein the main body of the container includes an extension which is continuous with said another limb and generally parallel and opposite said one limb, said extension, in use, ensuring correct spacing of the main body of the container relative to a doorjamb.

12. A container as claimed in claim 6, 7 or 11, wherein the second opening extends along one side of the container, and, in use, when the container is mounted on an edge of a door, is closed by a doorjamb associated with that edge of the door.

13. A container as claimed in claim 6, wherein each first means includes a first set of inwardly directed flanges around each first opening, and the uppermost first means further includes a second set of inwardly directed flanges spaced downwardly from the first set of flanges.

* * * * *